United States Patent [19]

Schaub

[11] Patent Number: 4,627,243

[45] Date of Patent: Dec. 9, 1986

[54] GAS SUPPLY SYSTEM FOR VARIABLE DEMAND APPLICATION

[75] Inventor: Herbert R. Schaub, Amherst, N.Y.

[73] Assignee: Union Carbide Corporation, Danbury, Conn.

[21] Appl. No.: 780,278

[22] Filed: Sep. 26, 1985

[51] Int. Cl.[4] ..... F17C 7/04; F04B 49/00; F04B 49/06; F04B 11/00

[52] U.S. Cl. ..... 62/52; 417/44; 417/53; 417/540; 417/543

[58] Field of Search ..... 417/18-22, 417/53, 44, 540, 543; 62/55, 52, 53; 137/211, 208

[56] References Cited

U.S. PATENT DOCUMENTS

| | | | |
|---|---|---|---|
| 2,362,968 | 11/1944 | Bliss et al. | 62/1 |
| 2,727,470 | 12/1955 | Ludwig | 417/543 |
| 2,732,804 | 1/1956 | Sadler | 417/543 |
| 3,058,315 | 10/1962 | Schuftan | 62/52 |
| 3,319,434 | 5/1967 | Matesanz | 62/45 |
| 3,847,507 | 11/1974 | Sakiyama | 417/22 |
| 3,962,882 | 6/1976 | Gee | 62/55 |
| 3,981,620 | 9/1976 | Abrahams | 417/22 |
| 3,985,467 | 10/1976 | Lefferson | 417/22 |
| 4,108,574 | 8/1978 | Bartley | 417/22 |
| 4,397,610 | 8/1983 | Krohn | 417/44 |
| 4,474,104 | 10/1984 | Creffield | 91/497 |

OTHER PUBLICATIONS

Haynes, J., Efficient Control of AC Motors, Production Engineering, Feb. 19, 1984, pp. 62-65.

Kingsley, P., Programmable Controllers and Adjustable Speed Drives Work Well Together, The Magazine of Industrial Motion and Control, Feb. 1984, pp. 33-35.

*Primary Examiner*—William L. Freeh

*Attorney, Agent, or Firm*—Stanley Ktorides

[57] ABSTRACT

A system for the supply of gas to a variable flowrate consumption use point comprising monitoring specified system parameters, making specified determinations, and adjustable the liquid pump speed accordingly. Preferably the monitoring is computerized. The invention results in a less costly and more efficient gas supply system.

22 Claims, 3 Drawing Figures

GAS SUPPLY SYSTEM FOR VARIABLE DEMAND APPLICATION

TECHNICAL FIELD

This invention relates to the supplying of high pressure vaporized liquid to a use point and is an improvement wherein such vaporized liquid can be supplied to a variable demand use point with reduced capital costs and with increased efficiency.

BACKGROUND ART

Many industrial and other systems employ gaseous material at a variable or intermittent rate. Examples of such systems include the use of oxygen as oxidant gas for combustion, the use of nitrogen gas for heat treating or inerting atmospheres, and the use of hydrocarbon gas as fuel. For a number of reasons including safety, convenience, and economics, it is preferred to store the gaseous material in liquid form and to vaporize the liquid to the gaseous form when needed. Thus, a typical gas supply system includes a liquid storage tank and means to vaporize the liquid to the gaseous form. A liquid pump may be used to pump the liquid to an increased pressure, and upon vaporization the high pressure gas will flow to the use point. When the gas usage is at a constant rate this is all that is needed. For this situation, the liquid pump is sized to correspond to the required constant flow rate and available constant speed constant flow units are satisfactory. However, if the gas usage is at a variable rate, a gas storage tank is needed in order to avoid gas venting during low demand time periods and to supply added gas during high demand time periods.

The constant flowrate liquid pump must be sized to match the average usage demand flow. A pump sized smaller than the average demand flow would be inadequate. A pump sized larger than the average demand flow would require either venting the gas or a large number of pump stoppages. Venting of the gas is obviously undesirable and costly. Excessive numbers of pump stoppages are also undesirable because each time the pump starts it must be recooled to the liquid temperature. This recooling expends both energy and product, and desirably is minimized for efficient operation.

Although the liquid pump must be sized to match the average usage demand flow, the gas storage tank must be sized to meet the highest usage rate for the variable rate use point. This requirement can entail high capital costs in those situations where the variable demand maximum usage rate is high compared to the average. Further, this situation can lead to high capital costs where the gas supply must be at a high pressure level, since the necessary gas storage tanks operate at even higher pressure levels. Accordingly, it is desirable to have a system which can adequately supply gas to a variable demand rate usage point at a high pressure level while allowing for the gas storage tank size requirement to be significantly reduced.

It is therefore an object of this invention to provide an improved gas supply system for variable rate gas usage at high pressure levels.

It is another object of this invention to provide an improved gas supply system for variable rate gas usage whereby the gas storage tank size requirement is significantly reduced.

It is further object of this invention to provide an improved gas supply system for variable rate gas usage wherein the need to stop and restart the liquid pump is reduced.

SUMMARY OF THE INVENTION

The above and other objects which will become apparent to those skilled in the art are attained by the present invention one aspect of which is:

A method of providing gas to a variable consumption flowrate use point comprising: pumping liquid at an initial flowrate to a high pressure with a variable speed liquid pump having a maximum flowrate capability at least twice its minimum flowrate capability, vaporizing high pressure liquid to produce high pressure gas, passing high pressure gas to a high pressure gas storage tank, delivering high pressure gas from the storage tank to the use point, monitoring the use point consumption flowrate of said gas, determining if the use point consumption flowrate differs from the liquid pump initial flowrate, and, based on this determination, adjusting the liquid pump speed to provide a flowrate corresponding to the use point consumption flowrate, whereby the size of the high pressure gas storage tank is significantly reduced.

Another aspect of the present invention is:

A method for providing gas to a variable consumption flowrate use point comprising: pumping liquid at an initial flowrate to a high pressure with a variable speed liquid pump having a maximum flowrate capability at least twice its minimum flowrate capability, vaporizing high pressure liquid to produce high pressure gas, passing high pressure to a high pressure gas storage tank, delivering high pressure gas from the storage tank to the use point, monitoring the pressure in the high pressure gas storage tank, determining whether the pressure in the high pressure gas storage tank is changing, and, based on this determination, adjusting the liquid pump speed to provide a flowrate corresponding to the use point consumption flowrate, whereby the size of the high pressure gas storage tank is significantly reduced.

As used herein the term "high pressure" means a pressure which exceeds 200 psia.

As used herein the terms "usage rate", "demand", and "consumption flow rate" are interchangeable, and mean the rate at which the use point uses gas.

As used herein the term "corresponding to the use point consumption flowrate" does not necessarily mean matching the use point consumption flowrate but rather means better reflecting the system needs given the determined use point consumption flowrate.

DETAILED DESCRIPTION

Figure 1:
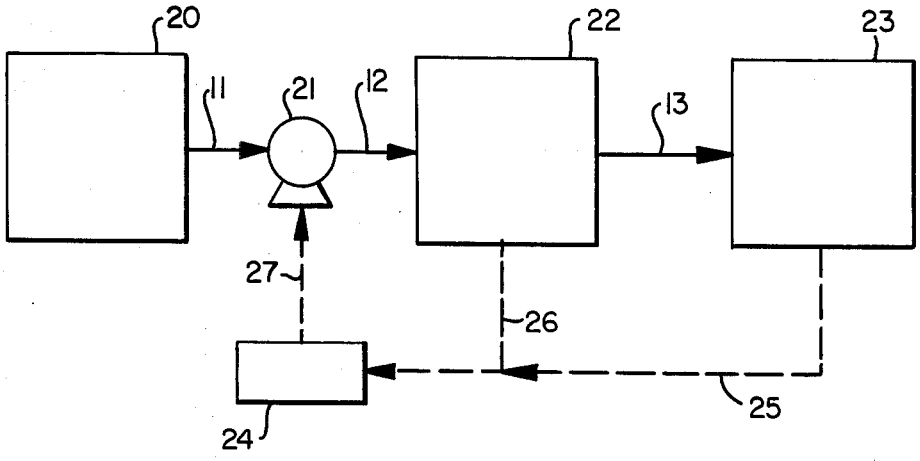
FIG. 1 is a simplified schematic representation of one system which can employ the method of this invention.

FIG. 1 illustrates in simplified schematic form the improved gas supply system of this invention. Referring now to FIG. 1, liquid is stored in liquid storage tank 20. Among the many liquids which can be vaporized and delivered to a variable demand use point by the present invention, one can name, liquid oxygen, liquid nitrogen, liquid argon and liquified petroleum gas.

The liquid is removed from liquid storage tank 20, such as by passage through conduit means 11, and pumped to a high pressure by variable speed liquid pump 21 which has a maximum flowrate capability at least twice its minimum flowrate capability. The liquid pump maximum flowrate capability may be up to or even exceed ten times the minimum flowrate capability and preferably has a maximum flowrate capability in the range between three to six times the minimum flowrate capability. Preferably the liquid pump minimum flowrate capability is at most 40,000 SCFH and is in the range of from 5000 to 40,000 SCFH, while the liquid pump maximum flowrate capability is at least 20,000 SCFH and is in the range of from 20,000 to 160,000.

The abbreviation "SCFH" means standard cubic feet per hour and, when used to describe liquid flow, means liquid equivalent to gas flow at standard conditions of 14.7 psia and 70° F.

The pump is a variable speed unit having a variable speed electric motor on the pump drive. The rotational speed of the motor is directly related to the frequency of the alternating power. The frequency of the line power can be converted by a conventional adjustable frequency drive. The use of a solid state controller to produce variable voltage and frequency to control the pump motor speed has the advantage of maintaining a constant torque output from the motor over a wide range of speeds. The liquid pump may be a positive displacement reciprocating pump. Other types of pumps suitable for use with this invention include rotary impeller units.

The liquid pump 21 pumps the liquid, which is generally stored at ambient pressure in storage tank 20, to a high pressure which exceeds 200 psia. Generally, such high pressure will be at least 500 psia and preferably within the range of from 1000 to 5000 psia. The liquid is vaporized at this high pressure to produce high pressure gas. Any suitable means of vaporizing the high pressure liquid to produce high pressure gas is acceptable for use with this invention. Among such vaporizing means one can name a water bath vaporizer heated by steam, a direct fired vaporizer utilizing any suitable fuel, and an atmospheric vaporizer. The vaporizing means are not illustrated in FIG. 1; however, the vaporizing means would be located between pump 21 and gas storage tank 22.

The high pressure gas is passed, such as by passage through conduit means 12, to high pressure gas storage tank 22 and from there is delivered, such as by passage through conduit means 13, to use point 23. Gas storage tank 22 is sized according to the end use requirements and generally will be able to store gas at a pressure up to about 2000 or even 6000 psia. When the use point consumption flowrate exceeds the flowrate provided by the liquid pump, i.e. the gas flowrate into the high pressure storage tank, the amount of gas in the gas storage tank and consequently the pressure within the gas storage tank is decreased. When the use point consumption flowrate is less than the flowrate provided by the liquid pump, the amount of gas and consequently the pressure within the gas storage tank is increased.

The method of this invention enables the use of a much smaller gas storage tank than is necessary by conventional methods. The method of this invention monitors one or both of two variables. The two variables are the use point consumption flowrate and the pressure within the high pressure gas storage tank. The preferred monitoring means of this invention is a computer such as a process computer, a minicomputer, a microprocessor or shared time on a large computer such as might be associated with other plant operations. In FIG. 1 the monitoring means 24 is shown schematically as receiving inputs through monitoring lines 25 and 26 respectively for use point consumption flowrate and gas storage tank pressure. The monitoring also causes, through control line 27, the pump speed to be adjusted to provide a flowrate corresponding to the use point comsumption flowrate. As indicated, the use point consumption flowrate is variable; it may be continuous wherein the usage rate varies but some gas is being consumed or it may be intermittent wherein there are periods when no gas is being consumed.

When the use point consumption flowrate is the system parameter that is being monitored, the gas supply system of this invention operates as follows. The monitor determines if the use point consumption flowrate differs from the flowrate which is being delivered by the liquid pump which may be termed the initial flowrate, and, on the basis of this determination, causes the liquid pump speed to be adjusted to provide a flowrate corresponding to the use point consumption flowrate. The adjustment may comprise increasing or decreasing the liquid pump speed to provide a flowrate which substantially matches the use point consumption flowrate. The adjustment may comprise operating the liquid pump speed to provide a flowrate which exceeds the use point consumption flowrate, thus increasing the amount of gas in the high pressure gas storage tank. Alternatively the adjustment may comprise operating the liquid pump speed to provide a flowrate which is less than the use point consumption flowrate, thus decreasing the amount of gas in the high pressure gas storage tank. These latter two situations include the situations where the use point consumption flowrate respectively is less than the liquid pump minimum flowrate capability or greater than the liquid pump maximum flowrate capability. Yet another adjustment comprises shutting the pump off completely.

When the pressure in the high pressure gas storage tank is the system parameter that is being monitored, the gas supply system of this invention operates as follows. The monitor determines if the pressure in the high pressure gas storage tank is changing, and, on the basis of this determination, causes the liquid pump speed to be adjusted to provide a flowrate corresponding to the use point consumption flowrate. The adjustment may comprise increasing the liquid pump speed to cause the storage tank pressure to stop decreasing so as to stabilize or to increase. Alternatively the adjustment may comprise decreasing the liquid pump speed to cause the storage tank pressure to stop increasing so as to stabilize or to decrease. As can be appreciated, where the gas tank pressure is neither increasing or decreasing the flowrate provided by the liquid pump substantially matches the use point consumption flowrate. The gas pressure monitoring method may be effectively employed to keep the pressure within the high pressure gas storage tank within predetermined minimum and maximum pressure levels, independent of the changes in the use point consumption flowrate. The gas pressure monitoring method may be somewhat simpler to implement because it involves the monitoring of a parameter which is easily measured.

The monitoring of the use point consumption flow-rate and/or the pressure in the high pressure gas storage tank may be continuous or it may be intermittent.

Figure 2:
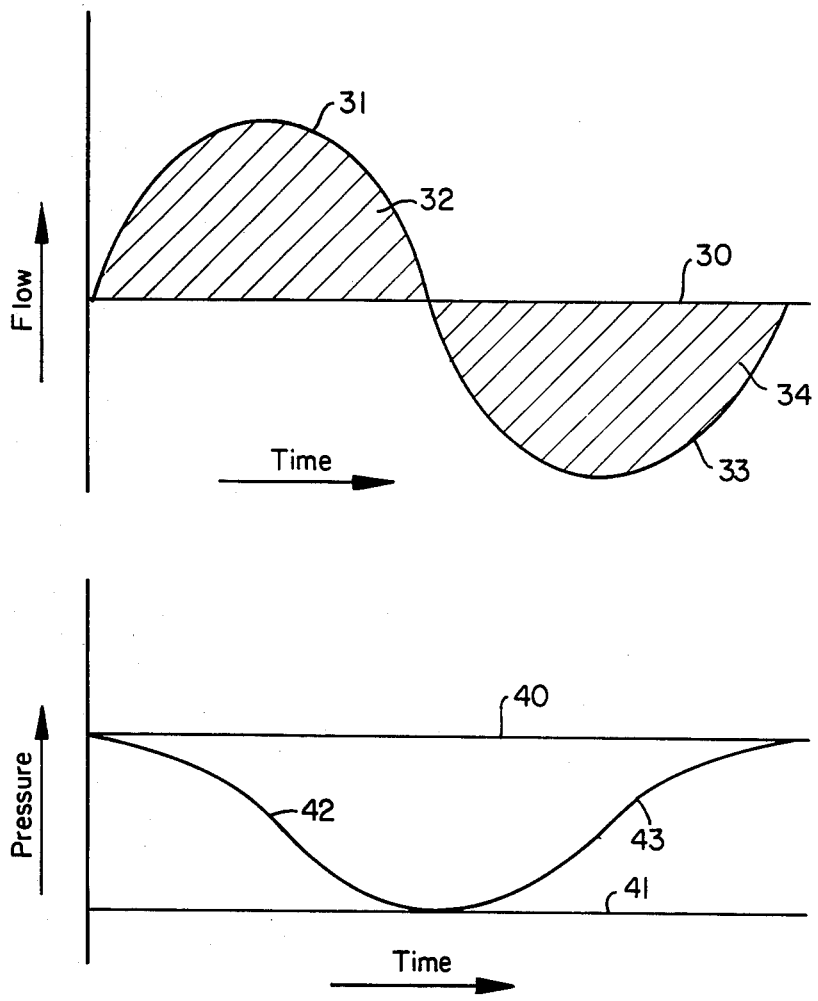
PRIOR ART FIG. 2
FIG. 2 is a graphical representation of gas supply system flow and pressure characteristics of a conventional gas supply system.

The advantages of the method of this invention can be illustrated by reference to FIGS. 2 and 3. FIG. 2 is an idealized graphical representation of flow and pressure characteristics for a conventional gas supply system employing a constant speed pump. As noted previously, the liquid pump flow on a time average basis must be equal to the usage demand flow. Accordingly, on FIG. 2, the flow 30 can correspond to the flow associated with the liquid pump and thereby with the time average usage flow. If one considers that the usage flow is actually greater than the pump flow at times and less than the pump flow at other times, a typical representation can be illustrated as a sinusoidal curve shown on the graph with usage flow 31 above the average and usage flow 33 below the average. Note that on a time average basis, the added and reduced flows cancel and thus correspond to the average flow. When the use point requires a flow greater than the pump flow, then additional flow is obtained from gas storage, whereas if the use point requirement is less than the pump flow, then the additional pump capacity can be used to replenish the gas storage. Accordingly, in the illustration of FIG. 2, when the usage flow is greater than average, that is Curve 31, material equivalent to the integrated area 32 is withdrawn from the gas storage tank and added to the pump flow to supply the usage demand. On the other hand, when the usage requirement flow 33 is lower than the pump flow 30, then material equal to integrated area 34 can be replenished from the pump to the gas storage tank.

The pressure level of the gas storage tank associated with the operation of the system is also illustrated on FIG. 2. Note that if the maximum pressure level corresponds to 40 and the minimum pressure level corresponds to 41, then as a function of time the pressure level in the gas storage will vary between those two limits. During gas withdrawal from the reservoir, curve 42 shows a slow decrease in pressure and then an increased decrease in pressure and than a slower decrease in pressure corresponding to sinusoidal flow demand above the pump level. Conversely, when the gas storage tank pressure is building, then Curve 43 shows a slow increase in pressure level, a rapid increase and than a slower increase back to the maximum pressure level. An important thing to note from the conventional system is that the arrangement requires flow from gas storage anytime that the demand is above the pump level and to gas storage any time the demand is below pump level. Accordingly, usage flow and pump flow are almost never matched and gas storage is always being used as a ballast to convert the variable usage flow rate to a flow that can be handled to a constant flow rate pump. In order for this system to be operational and supply the flow as shown in the illustration, the amount of gas storage required must be capable of holding material represented by the integrated flow versus time area corresponding to flow above the pump flow for the half cycle. This arrangement then allows the system to replenish gas storage during half of the cycle and draw from gas storage during the other half of the cycle.

Figure 3:
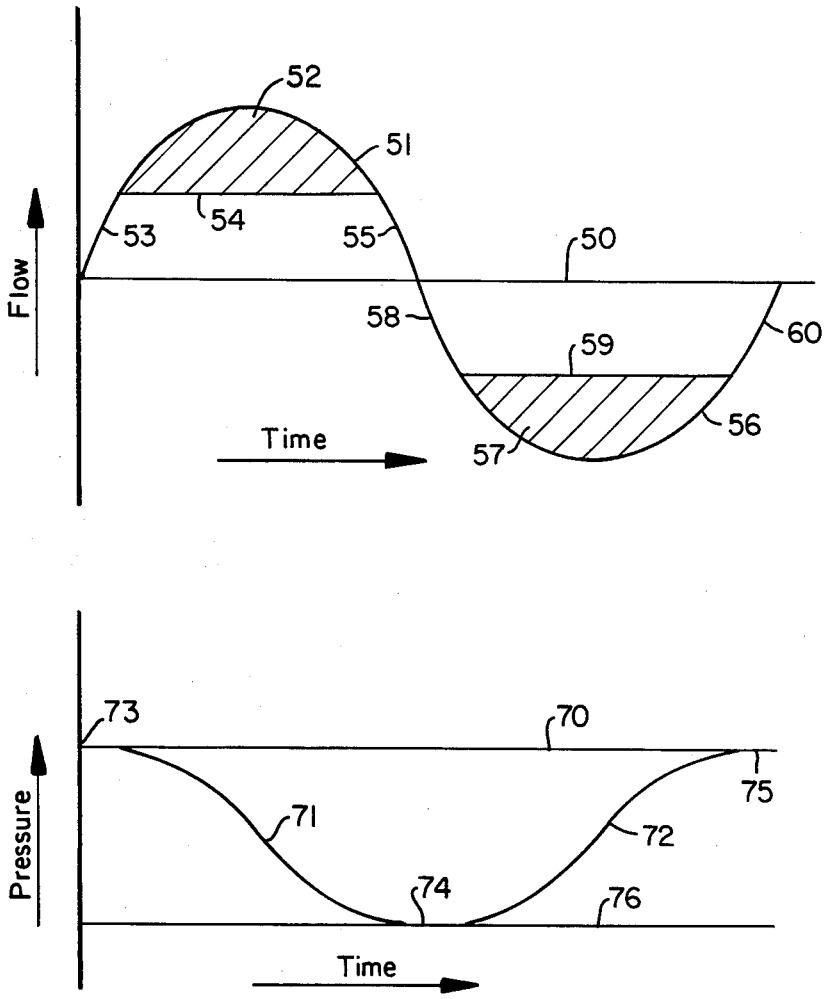
FIG. 3 is a graphical representation of gas supply system flow and pressure characteristics of the improved gas supply system of this invention.

FIG. 3 is an idealized graphical representation of flow and pressure characteristics for a gas supply system employing the method of this invention including the variable speed liquid pump. For comparative purposes, the illustrative usage flow is the same as for the conventional system illustration. As before the average flow 50 must be equal for the usage demand and the liquid pump. The gas storage tank is a ballast on the system and supplies gas during the high demand periods and can be replenished during low demand periods but does not supply any net material. As shown, the average use point flow 50 is a flow rate that considers the high flow rate 51 and the low flow rate 56 for the use point. The liquid pump unit is capable of following the customer flow rate over some range but must then be aided by the gas storage tank reservoir. As shown, the liquid pump is capable of operating at a maximum flow rate 54 and a minimum flow rate 59 which for illustration purposes is three units above the average and three units below the average. Accordingly, the pump could supply the use point demand directly through some of the range including flow demand 53, 55, 58 and 60. On the other hand when the demand is high and the pump is at its maximum flow rate 54 then gas must be taken from the gas storage tank and added to the pump flow rate in order to supply the usage demand 51. Likewise, when usage demand rate is low 56 and the pump is at the lowest level possible 59, its excess capacity can be used to replenish the gas storage. If the gas storage operates between minimum pressure 76 and maximum pressure 70, then when gas is being withdrawn, the pressure will drop as shown by curve segment 71 whereas the gas storage is being replenished the pressure will rise as shown by curve segment 72. Note that during those time periods when the pump is supplying the usage demand flow directly, the gas storage pressure does not change at all. These time periods when the gas storage does not interact with the system correspond to time period 73 that corresponds to rising flow 53, 74 that corresponds to falling flow 55 and 58 and time period 75 that corresponds to rising flow 60. As before, the illustration of FIG. 3 is an idealized one that assumes that gas storage will be replenished during the low demand periods and will supply additional gas only during high demand periods. At all other times in this idealized system, the pump will follow the use point demand directly. Although idealized, the curve illustrates the very significant advantage illustrated with the system which is related to the amount of gas storage required to supply the variable demand use point. As can be seen, this system can supply the same variable use point demand as the conventional system with a gas storage requirement which is considerably less than that required for the conventional system. The amount of gas storage is directly represented by area 52 and 57 and this integrated area of flow rate over time represents the gas storage requirement of the gas supply system of this invention. Since the liquid pump can follow the use point demand over a major portion of the flow range, only the remaining flow range must be handled by the gas storage tank. For the illustration shown, it can be seen that approximately only half of the amount of material need be stored in the gas storage tank for the improved system of this invention compared to the conventional system. It should be noted that for use point pressure level requirements equivalent to the conventional system, the pressure levels involved will be the same but the water volume of the gas storage tank will be approximately half that required for the conventional system. Accordingly, the gas supply system of this invention requires much less gas storage tank capacity and is therefore more economical than the conventional system.

In order to further illustrate the advantages of the gas supply system of this invention, consider a variable demand usage requirement as shown in FIGS. 2 and 3. Assume the idealized use point as having an average demand of 20,000 scfh (standard cubic feet of gas per hour) with a minimum of 5000 scfh and a maximum of 35,000 scfh. Further assume that the system minimum operating pressure is 1000 psig (pounds per square inch gauge) and maximum of 2000 psig and has a repeating pattern every four hours. For supply of nitrogen gas, such a variable demand user would require with a conventional system a high pressure gas storage tank reservoir of 293 $ft^3$ water volume. The gas supply system of this invention with a variable speed pump capable of 10,000 to 30,000 scfh (hour) flow rangeability would require a reservoir of only 54 $ft^3$ water volume. Although the gas storage tank volume requirements will vary with each individual situation, the gas supply system of this invention can reduce the gas storage tank requirements by up to 90 percent over that which would be required by a conventional gas supply system addressing the same situation.

The gas supply system of this invention is particularly advantageous for higher pressure gas delivery because the reduction of the high pressure gas storage tankage results in greater cost reductions with increased pressure. At gas delivery pressures less than about 200 psia, high pressure gas storage tankage generally would not be necessary. Furthermore, this invention is particularly applicable for use with subambient temperature liquids, i.e. those liquids which would be gases at ambient temperature and pressure. This is because the much higher incidence of stopping and restarting which characterizes conventional systems which do not have very large gas storage tanks is particularly troublesome for subambient temperature liquids due to the large amount of vapor loss vaused by the large number of stops and restarts.

I claim:

1. A method for providing gas to a variable consumption flowrate use point comprising: pumping liquid at an initial flowrate to a high pressure with a variable speed liquid pump having a maximum flowrate capability at least twice its minimum flowrate capability, vaporizing high pressure liquid to produce high pressure gas, passing high pressure gas to a high pressure gas storage tank, delivering high pressure gas from the storage tank to the use point, monitoring the use point consumption flowrate of said gas, determining if the use point consumption flowrate differs from the liquid pump initial flowrate, and, based on this determination, adjusting the liquid pump speed to provide a flowrate corresponding to the use point consumption flowrate, whereby the size of the high pressure gas storage tank is significantly reduced.

2. The method of claim 1 wherein the use point consumption flowrate exceeds the liquid pump initial flowrate but is less than the liquid pump maximum flowrate wherein the adjustment comprises increasing the liquid pump speed to provide a flowrate which matches the use point consumption flowrate.

3. The method of claim 1 wherein the use point consumption flowrate is less than the liquid pump initial flowrate but exceeds the liquid pump minimum flowrate wherein the adjustment comprises decreasing the liquid pump speed to provide a flowrate which matches the use point consumption flowrate.

4. The method of claim 1 wherein the use point consumption flowrate is less than the liquid pump maximum flowrate wherein the adjustment comprises operating the liquid pump at a speed to provide a flowrate which exceeds the use point consumption flowrate and storing excess high pressure gas in the high pressure gas storage tank.

5. The method of claim 1 wherein the use point consumption flowrate exceeds the liquid pump minimum flowrate wherein the adjustment comprises operating the liquid pump at a speed to provide a flowrate which is less than the use point consumption flowrate, and providing additional high pressure gas to the use point from the high pressure gas storage tank.

6. The method of claim 1 wherein the use point consumptin flowrate exceeds the maximum liquid pump flowrate wherein the adjustment comprises operating the liquid pump at or below its maximum flowrate capability and providing additional high pressure gas from the high pressure gas storage tank to the use point.

7. The method of claim 1 wherein the use point consumption flowrate is less than the minimum liquid pump flowrate capability wherein the adjustment comprises operating the liquid pump at or above the minimum flowrate capability and storing excess high pressure gas in the high pressure gas storage tank.

8. The method of claim 1 wherein the use point consumption flowrate is less than the minimum liquid pump flowrate capability wherein the adjustment comprises shutting the liquid pump and supplying the entire use point requirements from the high pressure gas storage tank.

9. The method of claim 1 wherein the monitoring of the use point consumption flowrate is continuous.

10. The method of claim 1 wherein the monitoring of the use point consumption flowrate is intermittent.

11. The method of claim 1 wherein the monitoring of the use point consumption flowrate is carried out by use of a computer.

12. The method of claim 1 wherein said liquid is a subambient temperature liquid.

13. A method for providing gas to a variable consumption flowrate use point comprising: pumping liquid at an initial flowrate to a high pressure with a variable speed liquid pump having a maximum flowrate capability at least twice its minimum flowrate capability, vaporizing high pressure liquid to produce high pressure gas, passing high pressure gas to a high pressure gas storage tank, delivering high pressure gas from the storage tank to the use point, monitoring the pressure in the high pressure gas storage tank, determining whether the pressure in the high pressure gas storage tank is changing, and, based on this determination, adjusting the liquid pump speed to provide a flowrate corresponding to the use point consumption flowrate, whereby the size of the high pressure gas storage tank is significantly reduced.

14. The method of claim 13 wherein the pressure in the high pressure gas storage tank is increasing wherein the adjustment comprises reducing the liquid pump speed.

15. The method of claim 13 wherein the pressure in the high pressure gas storage tank is decreasing wherein the adjustment comprises increasing the liquid pump speed.

16. The method of claim 13 wherein the pressure in the high pressure gas storage tank is kept between a predetermined minimum and maximum pressure by operating the liquid pump at a speed inclusive between its maximum and minimum flowrate capability so as to keep the pressure within the high pressure gas storage tank from falling below the predetermined minimum or rising above the predetermined maximum.

17. The method of claim 13 wherein the pressure in the high pressure gas storage tank is increasing wherein the adjustment comprises operating the liquid pump at a speed to enable the pressure in the tank to increase toward the predetermined maximum by providing a flowrate which exceeds the use point consumption flowrate.

18. The method of claim 13 wherein the pressure in the high pressure gas storage tank is decreasing wherein the adjustment comprises operating the liquid pump at a speed to enable the pressure in the tank to decrease toward the predetermined minimum by providing a flowrate less than the use point flowrate and additionally providing gas to the use point from the high pressure gas storage tank.

19. The method of claim 13 wherein the monitoring of the pressure in the high pressure gas storage tank is continuous.

20. The method of claim 13 wherein the monitoring of the pressure in the high pressure gas storage tank is intermittent.

21. The method of claim 13 wherein the monitoring of the pressure in the high pressure gas storage tank is carried out by use of a computer.

22. The method of claim 13 wherein said liquid is a subambient temperature liquid.

* * * * *

UNITED STATES PATENT AND TRADEMARK OFFICE

CERTIFICATE OF CORRECTION

PATENT NO. : 4,627,243

DATED : December 9, 1986

INVENTOR(S) : Herbert R. Schaub

It is certified that error appears in the above-identified patent and that said Letters Patent is hereby corrected as shown below:

In the Abstract, line 4, delete "adjustable" and insert therefor --adjusting--.

In column 2, line 32, after "pressure" first occurrence insert --gas--.

In column 6, line 28, after "whereas" insert --when--.

In column 7, line 17, delete "(hour)".

In column 7, line 39, delete "vaused" and insert therefor --caused--.

In claim 17, line 1, delete "13" and insert therefor --16--.

In claim 18, line 1, delete "13" and insert therefor --16--.

Signed and Sealed this

Seventeenth Day of March, 1987

*Attest:*

DONALD J. QUIGG

*Attesting Officer*

*Commissioner of Patents and Trademarks*